United States Patent [19]

Artzt et al.

[11] Patent Number: 4,653,260

[45] Date of Patent: Mar. 31, 1987

[54] PROCESS AND APPARATUS FOR PREPARING A CUT-TO-LENGTH THREAD END FOR THE RE-PIECING OF AN OPEN-END SPINNING MACHINE

[76] Inventors: Peter Artzt, Hugo-Wolf-Str. 16, 7410 Reutlingen; Heinz Müller, Geibelstr. 1, 7430 Metzingen-Nauhausen; Gerhard Egbers, Hugo-Wolf-Str. 22, 7410 Reutlingen; Gunther Böhm, Böhming Nr. 36, 8079 Kipfenberg; Stephan Wittmann, Plumelstr. 67; Rupert Karl, Thomastr. 13a, both of 8070 Ingolstadt, all of Fed. Rep. of Germany

[21] Appl. No.: 735,327

[22] Filed: May 17, 1985

[30] Foreign Application Priority Data

May 19, 1984 [DE] Fed. Rep. of Germany ..... 3418780
Jun. 16, 1984 [DE] Fed. Rep. of Germany ..... 3422526

[51] Int. Cl.[4] ..... D01H 15/02
[52] U.S. Cl. ..... 57/263; 57/23
[58] Field of Search ..... 57/22, 23, 261, 263

[56] References Cited

U.S. PATENT DOCUMENTS

| | | | |
|---|---|---|---|
| 3,455,095 | 7/1969 | Makeham | 57/263 |
| 3,695,017 | 10/1972 | Hori et al. | 57/263 |
| 3,807,270 | 4/1974 | Wirz | 57/22 X |
| 3,924,393 | 12/1975 | Stahlecker et al. | 57/263 |
| 3,924,394 | 12/1975 | Stahlecker et al. | 57/263 |
| 3,925,975 | 12/1975 | Stahlecker et al. | 57/263 |
| 3,942,311 | 3/1975 | Stahlecker | 57/263 |
| 3,962,855 | 6/1976 | Stahlecker | 57/263 |
| 4,054,024 | 10/1977 | Tsubata et al. | 57/263 X |
| 4,263,775 | 4/1981 | Mima | 57/22 |
| 4,369,620 | 1/1983 | Burysék et al. | 57/405 X |
| 4,406,115 | 9/1983 | Negaty-Hindi et al. | 57/22 |
| 4,439,978 | 4/1984 | Mima | 57/261 X |
| 4,476,671 | 10/1984 | Rohner et al. | 57/22 X |
| 4,494,371 | 1/1985 | Morita et al. | 57/263 |
| 4,497,165 | 2/1985 | Völlm | 57/22 |
| 4,528,808 | 7/1985 | Luz | 57/22 |

FOREIGN PATENT DOCUMENTS

| | | | |
|---|---|---|---|
| 2203198 | 8/1973 | Fed. Rep. of Germany . | |
| 1710021 | 10/1975 | Fed. Rep. of Germany . | |
| 2112036 | 7/1983 | United Kingdom | 57/22 |

*Primary Examiner*—Stuart S. Levy
*Assistant Examiner*—Joseph J. Hail, III
*Attorney, Agent, or Firm*—Julian W. Dority

[57] ABSTRACT

To improve the re-piecing operation, especially in terms of its success rate, at high spinning speeds, the free thread end cut to the length of a piecable end and retained after cutting the length is exposed to a turbulent air flow which causes it to execute whiplash-like oscillations. The surface of the thread end is thereby roughened. The thread end prepared in this way is subsequently transferred to the fiber-collecting surface of the open-end spinning apparatus. The roughening of the surface of the free thread end is accelerated when the end is whipped against an edge-like projection or a rough surface.

45 Claims, 7 Drawing Figures

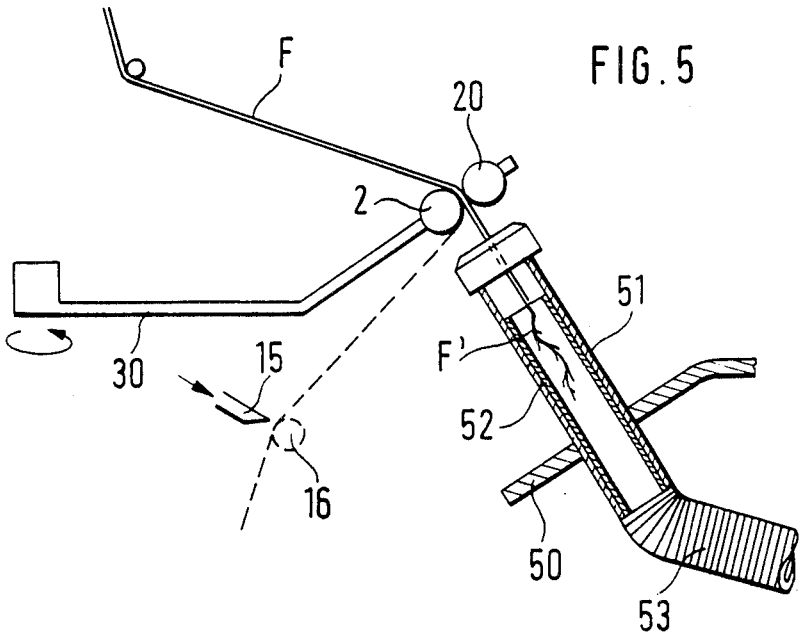
FIG. 5
FIG. 6
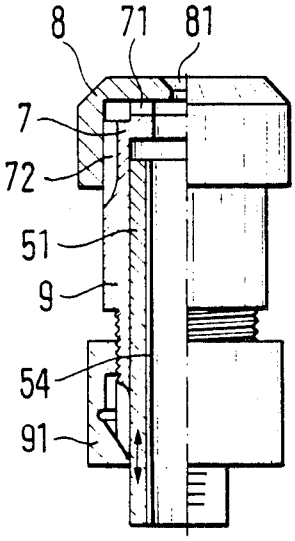
FIG. 7
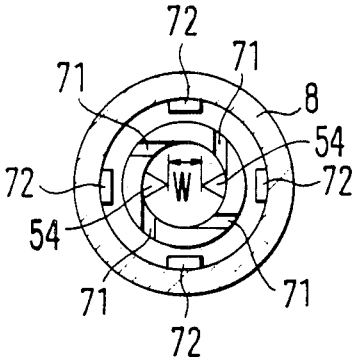

PROCESS AND APPARATUS FOR PREPARING A CUT-TO-LENGTH THREAD END FOR THE RE-PIECING OF AN OPEN-END SPINNING MACHINE

BACKGROUND OF THE INVENTION

The invention relates to a process for preparing a thread for the re-piecing of an open-end spinning apparatus, in which the thread end is cut to the length of a piecable thread end, and to an apparatus for carrying out the process.

It is known to draw off from a bobbin the thread end required for the re-piecing of an open-end spinning apparatus, shorten it to a predetermined length (cut it to length), and then guide the thread end thus prepared back to the fiber-collection surface of the open-end spinning apparatus, where it is joined to the fibers fed onto the collecting surface (German Auslegeschrift No. 1,710,021 which is U.S. Pat. No. 3,455,095). The spinner usually cuts the thread end to length by severing the thread by means of a fingernail or, where stronger threads are concerned, over an edge, so that a frayed, but definite thread end is obtained. The thread end produced simply as a result of cutting usually does not provide sufficient piecing conditions, so that, particularly at high rotor speeds, the success rate for joining the thread is inadequate.

It is also known to shorten the thread purely pneumatically to the length desired for joining (German Offenlegungsschrift No. 2,203,198). In this case, the free thread end is untwisted by a circulating air flow and detached from the remaining thread by being pulled pneumatically, so that a thread end with a fiber tuft is obtained.

Apart from the fact that this does not produce an exact point of separation and consequently a specific length of the thread end, it has been shown, when threads are joined at high rotor speeds, that the success rate of the joining operation is, as before, unsatisfactory.

SUMMARY OF THE INVENTION

The object of the present invention is to improve automatic thread-joining on open-end spinning apparatus, especially in terms of its success rate, at high rotor speeds or spinning speeds.

This object is achieved according to the invention because, after being cut to length, the retained free thread end is exposed to a turbulent air flow which causes the thread end to execute whiplash-like oscillations, and the thread end prepared in this way is subsequently transferred to the fiber-collecting surface of the open-end spinning apparatus.

Surprisingly, it has been shown that by means of this process a considerable improvement in the success rate of thread-joining is achieved even at high rotor speeds or spinning speeds, so that there is essentially no need to lower the rotor speed for the joining operation in relation to the normal spinning operation. The further advantage of the process is that the prepared thread length is freely selectable, irrespective of the staple length, and can be matched to differing piecing conditions.

The startling success of the process is obviously based on the fact that the thread end is roughened over a specific length which can be made the most effective possible, according to the spinning parameters, without this part suffering the loss of strength which removal of twist, and parallel arrangement of the fibers, would cause. A more roughened surface is produced in this part of the thread end, and its fibers which project but are still tied in on one side have a very close affinity with the fibers in the spinning rotor or another fiber-collecting surface so that a rapid and very firm connection is made.

The preparation of the thread end is simplified because the thread to be prepared for the piecing operation is paid out from the thread take-up position to a point beyond the preparation device and is subsequently cut to length, whereupon the free thread end thus obtained is sucked into the preparation device. In this way, the free thread end is grasped by the air stream immediately after being cut to length and is introduced into the preparation device automatically.

Exact cutting to length is achieved because this is carried out by a cutting device. The roughening of the surface of the free thread end is accelerated because the free thread end is whipped against an edge-like projection or against a rough surface. The piecing success rate and the tying of the fibers to the free thread end are further improved when the free end of the thread is prepared in a length which is greater than the staple length. Appropriately, during preparation, the thread is retained at a distance from its free end which is 1.5 times the staple length.

The best possible piecing conditions for open-end rotor spinning are obtained when the free thread end is prepared in length which corresponds approximately to the diameter of the spinning rotor.

To make it easier to handle the thread for preparation, the free thread end, after being cut to length, is brought to the distance from the retention point which is necessary for preparation. It becomes easier to introduce the piecing thread into the spinning apparatus if, after preparation, the free end is brought to the length suitable for introduction into the spinning apparatus and, after introduction, is returned to the joining position, from which it is released for the joining operation.

Rapid preparation of the thread end is achieved because at least one edge-like projection or a rough surface is provided in the region of the oscillating thread end. In a preferred design, the free thread end is surrounded in its longitudinal direction by a tubular shield, through which the turbulent air flow is guided. For this purpose, the compressed-air nozzle is directed against the inner wall of the shield. Particularly effective air turbulence is generated because the compressed-air nozzle is directed into the shield at an acute angle relative to the center axis of the latter. To accelerate further the roughening of the surface of the free thread end, several compressed-air nozzles, the mouths of which are located opposite one another and which are subjected to compressed air in an alternating sequence, open into the shield. In the event that individual fibers come away from the point of separation or the thread surface when the free thread end is roughened, the shield can be connected to a suction line.

When a suction-air nozzle is used, this has one or more secondary air orifices behind the run-in orifice for the free thread end, as seen in the direction of flow. This ensures that the thread end is beaten particularly intensively against the rough inner surface of the shield. The secondary air orifices are arranged in such a way that they open into the suction-air nozzle off-center relative to the bore axis of the latter. The secondary air orifices preferably open into the suction-air nozzle tangentially relative to the inside diameter, thus producing an effective turbulent torsional flow which prevents the thread from untwisting. The suction-air nozzle can be produced in a simple way because the secondary air orifices are formed by a groove-like recess in the nozzle wall.

To ensure a sufficiently high turbulent suction-air flow, the flow cross-section of the run-in orifice is less than that of the secondary air orifice or orifices. When a conventional spinning vacuum with a head of water of 700 mm is used for the preparation of the thread, the diameter of the run-in orifice for the free thread end is 2 to 5 mm depending on the yarn thickness.

Appropriately, the run-in orifice is located in a cover engaging over the wall of the suction-air nozzle. The apparatus is consequently easily accessible and is therefore easy to maintain. It becomes easier to introduce the free thread end into the preparation device when the run-in orifice has a funnel-shaped widened portion, over which the thread-holding device can be positioned in close proximity. In a preferred design in which a powerful turbulent suction-air flow as closely as possible in synchronism with the spinning twist of the thread is generated, four secondary air orifices arranged offset relative to one another are distributed over the periphery of the suction-air nozzle, and each of the secondary air orifices communicates with the atmosphere via a bypass. The suction-air nozzle is connected to a suction line via the shield. It is particularly advantageous, here, if the suction line is connected to the suction device generating the spinning vacuum, since the spinning vacuum is coordinated with the fibers and the thread in accordance with the spinning process. Excessive stresses on the thread end are therefore avoided. In a design which simplifies the production of the apparatus, the suction-air nozzle is made in one piece with the shield.

A threading aid for the thread is provided when the shield is slotted in the longitudinal direction. If appropriate, the shield can be slotted towards the fiber-collecting surface in the direction of movement of the thread. In the preferred design, the shield is a square tube and is arranged essentially in the direction of emergence of the thread from the thread-holding device. This promotes the whiplash-like movement of the thread end as a result of the turbulent flow. However, the shield can also be arranged transversely relative to the direction of emergence of the thread from the thread-holding device. In a simple way in terms of construction, the shield is arranged stationary in the pivoting range of the thread-holding device. Alternatively, it is possible for the shield to be advanced to the free thread end. In this case, the shield can serve at the same time for guiding the free thread end into the thread draw-off tube of the spinning apparatus. According to previous experience, a clear width of the shield in a range from 8 to 15 mm for a given vacuum of 700 mm head of water has proved the best possible for preparing the free thread end by means of a suction-air stream. Appropriately, the shield is designed as a sleeve which is arranged so as to be axially displaceable in a mounting of the nozzle.

BRIEF DESCRIPTION OF THE DRAWINGS

Two exemplary embodiments of the invention are described with reference to the attached drawings. In the drawings:

FIG. 5 shows, partially in longitudinal section, a shield located in the pivoting range of the thread-holding device and having a suction-air nozzle;

FIG. 6 shows, partially in longitudinal section, a suction-air nozzle with a shield designed as a sleeve, in an enlarged representation; and FIG. 7 shows a cross-section through the suction-air nozzle according to FIG. 6.

DESCRIPTION OF A PREFERRED EMBODIMENT

Figure 1:
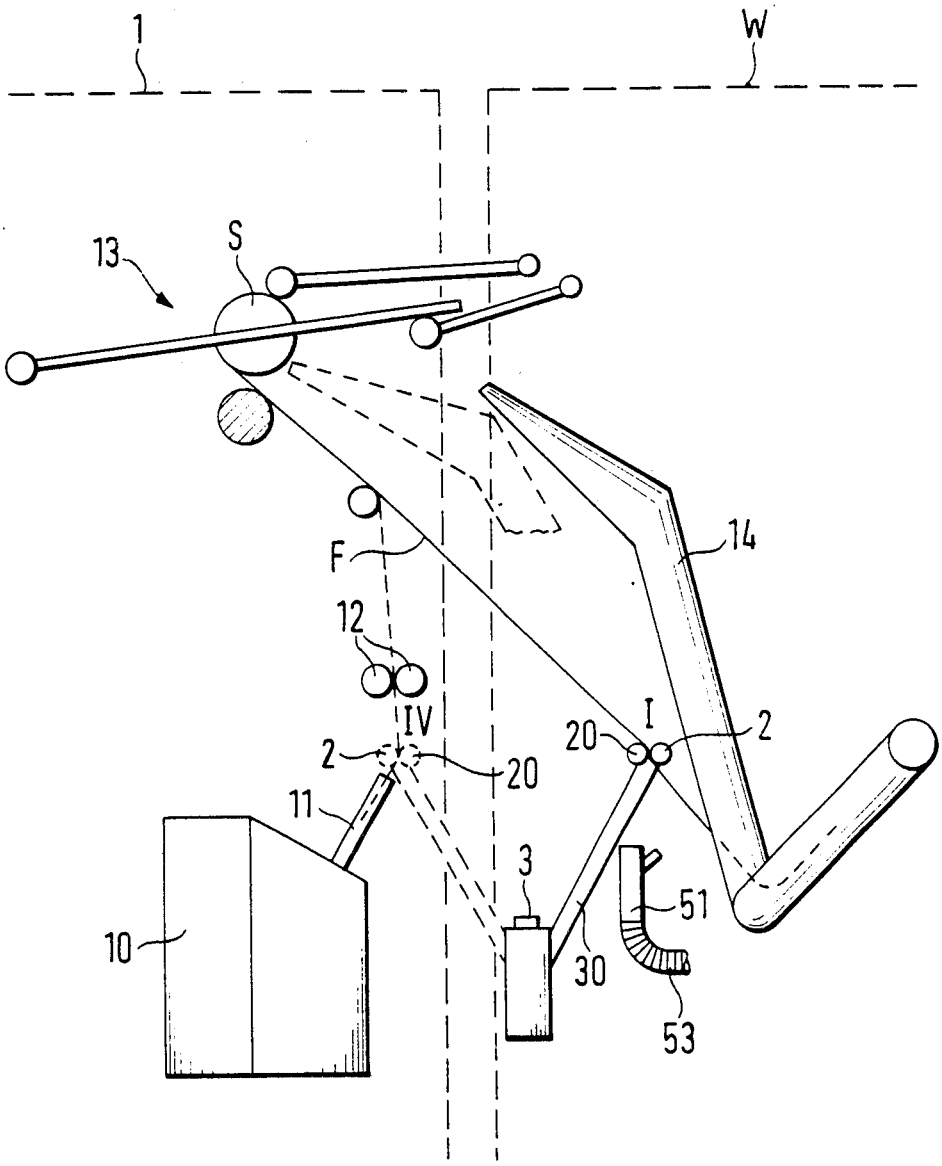
FIG. 1 shows a thread-joining apparatus during the joining operation at the spinning station.

The invention is described below with regard to an open-end rotor spinning apparatus, to which a servicing truck from which thread-joining is carried out as assigned. However, it can also be used advantageously on other open-end spinning apparatus, for example a friction spinning apparatus.

The spinning machine 1 (FIG. 1) usually has a plurality of spinning stations. The open-end spinning apparatus producing the thread is located in a housing 10. The housing 10 has a thread draw-off tube 11, through which the spun thread (broken line) leaves the open-end spinning apparatus and is drawn off by means of a pair of draw-off rollers 12. The thread is wound onto a bobbin S by means of the spooling device 13.

To service the spinning station there is a servicing apparatus W which is movable along the spinning stations and which attends to a wide variety of servicing operations, for example, also the repiecing of the thread at the spinning station after a thread breakage. It is necessary, for this purpose, to locate on the bobbin the broken thread which has run onto it, draw off the located thread end from the bobbin, and introduce it again into the spinning apparatus, so that contact with the fibers in the spinning apparatus is obtained and the spinning operation is consequently restarted. If the thread end is not rejoined to the fibers in the spinning apparatus during the first joining operation, the servicing apparatus repeats the attempt to join the thread, but this wastes time and the servicing capacity of the servicing apparatus is consequently impaired to a considerable extent. Moreover, the efficiency of the machine as a whole is lowered because the idle time of the spinning apparatus is lengthened. It is, therefore, essential that the success rate for thread-joining should be as high as possible.

If an interruption in the spinning process has occurred, it is customary to call the servicing apparatus to the particular spinning station, so that it can carry out the steps necessary for resuming the spinning process. It is customary first to clean fiber remains and dirt off from the spinning apparatus before the actual re-piecing operation is carried out.

For re-piecing, in the case of the apparatus described here by way of example, a suction tube 14 arranged on the truck of the servicing apparatus W can be moved out of the position of rest into a thread take-up position indicated by broken lines, in which the mouth of the suction tube 14 is located in front of the bobbin S. The bobbin S is lifted off from its drive roller and driven in the unwinding direction, and the suction tube 14 takes up the thread end. The thread is sucked through the suction tube 14 which is moved back again into its position of rest, and the thread emerges through a longitudinal slit in the suction tube 14 and extends freely from the bobbin S to the lower part of the suction tube 14.

Figure 3:
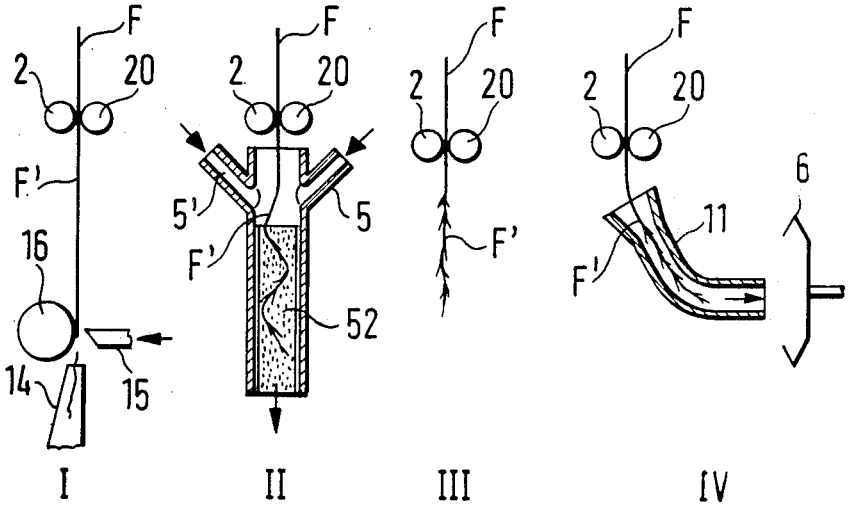
FIG. 3 shows, in a side view, an illustration of the individual phases in the preparation of the thread end and its transfer to the spinning apparatus.

To return the thread end taken up from the bobbin S by the suction tube 14 and unwound, there is a pair of clamping rollers 2, 20 which serves as a thread-holding device and which can be rotated by a drive means (not shown). The pair of rollers 2, 20 is mounted overhung on a pivoting arm 30 on the truck of the servicing apparatus W and is pivotable about an axle 3 between a thread take-up position I and a thread delivery position IV for returning the thread end into the thread outlet tube of the open-end spinning apparatus. The pair of rollers 2, 20, when pivoted, grasps the thread extending from the bobbin S to the lower part of the suction tube 14, whereupon the thread F is severed at a predetermined point underneath the pair of rollers 2, 20 holding it clamped. Severing is carried out by a knife 15 which, in interaction with an anvil roller 16, produces a definite thread end (FIG. 3, position I). The severed piece of thread is sucked through the suction tube 14.

The distance between the point of separation and the retention point of the thread F determined by the nip line of the pair of rollers 2, 20, and consequently the length of the free thread end F′ to be prepared for piecing, can be selected freely and fixed, irrespective of the staple length, according to the piecing conditions. In this regard, it has been shown that a free thread end F′ of a length greater than the staple length and preferably to 1.5 times the staple length makes it possible to carry out piecing without difficulty under the most diverse piecing conditions and with a very high success rate and produces a particularly firm joining piece.

Figure 2:
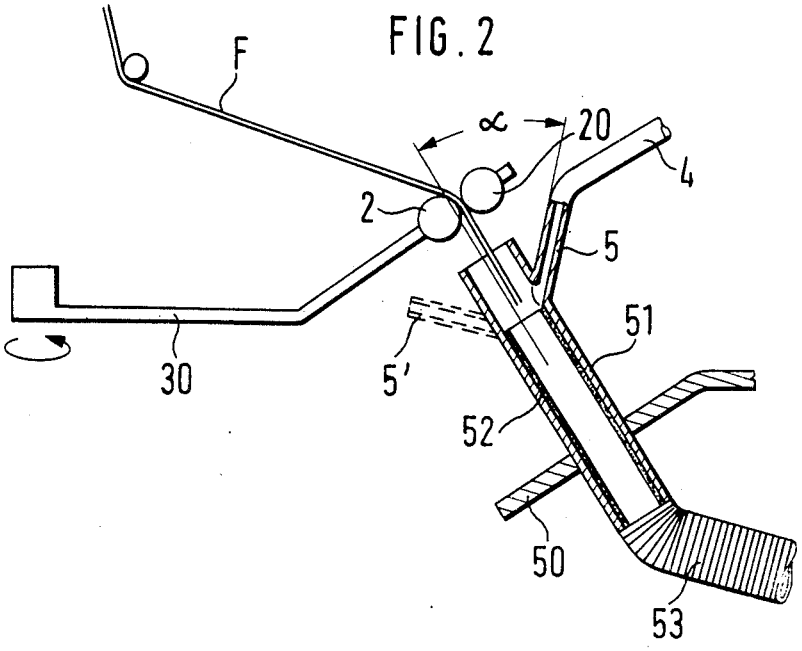
FIG. 2 shows, in a longitudinal section, a shield located in the pivoting range of a thread-holding device and having a compressed-air nozzle or compressed-air nozzles.

For preparing the cut-to-length thread end F′, the pair of rollers 2, 20 has assigned to it a compressed-air nozzle 5 which is connected to a compressed-air line 4 and which opens into a tubular shield 51 located in the pivoting range of the pair of rollers 2, 20 (FIG. 2). The shield 51 is arranged of means by a mounting 50 essentially in the direction of emergence of the thread F from the pair of rollers 2, 20. The compressed-air nozzle 5 is directed against the inner wall 52 of the shield 51, appropriately at an acute angle $\alpha$ relative to the center axis of the shield 51. Previous experience has shown that an angle $\alpha$ of approximately 45° is particularly favorable. The shield 51 is preferably designed as a square tube, but it can have another cross-section. To accelerate the preparation of the free thread end, the inner wall 52 is provided with at least one projection extending in the longitudinal direction of the shield 51 and having a sharp edge, or it possesses a rough surface. The latter can be produced cheaply by lining the inner wall 52 with sandpaper, conventional grain sizes being sufficient. The turbulent air flow required to prepare the thread end can be reinforced by a second compressed-air nozzle 5′, represented by broken lines in FIG. 2. For this purpose, it is expedient to make the second compressed-air nozzle 5′ open into the shield 51 at the same angle as the compressed-air nozzle 5, the mouths of the two compressed-air nozzles 5 and 5′ being located opposite one another. The nozzles are subjected to compressed air alternately by means of appropriately controlled valves.

Figure 4:
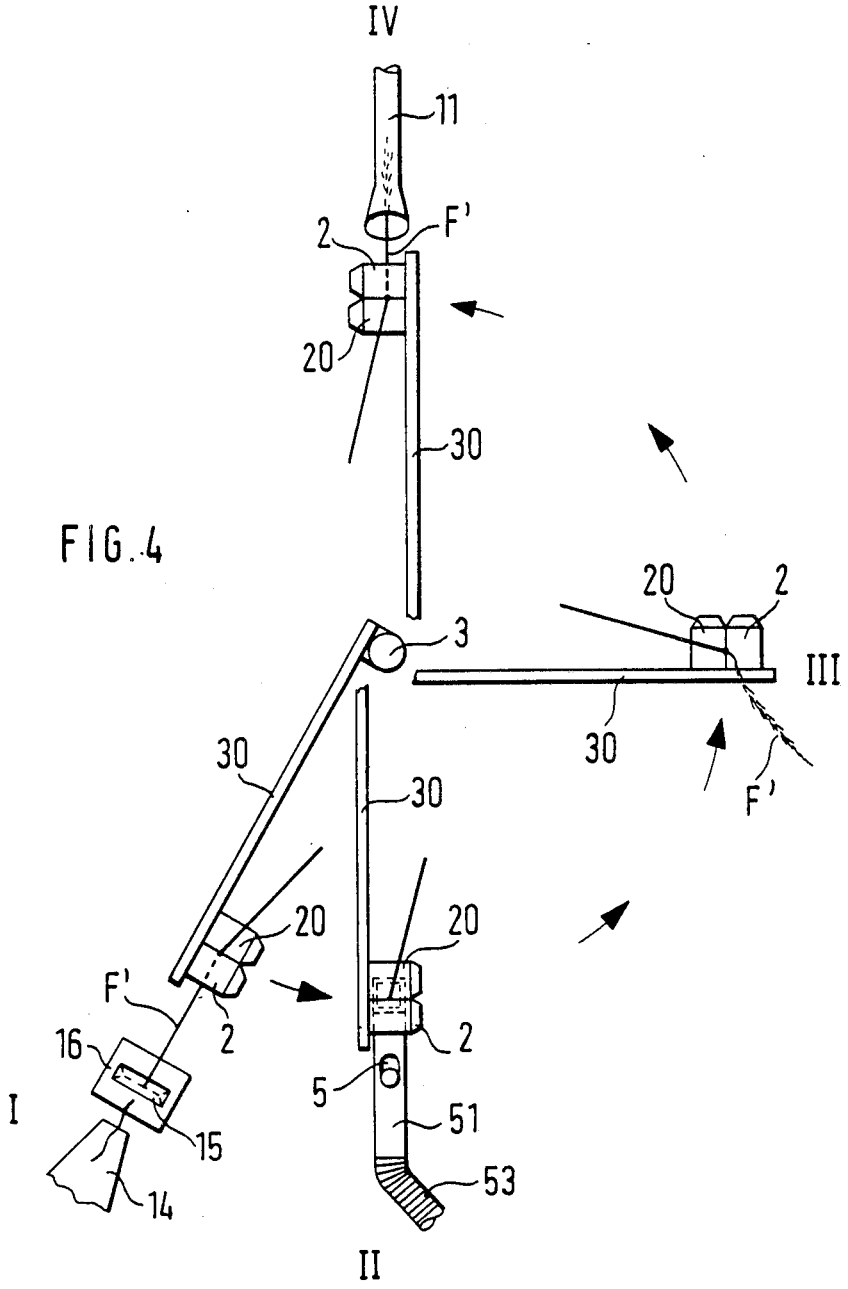
FIG. 4 shows the illustration according to FIG. 3 in a plan view.

After the operation of cutting to length, the pair of rollers 2, 20, with the free thread end F′ retained by it, is pivoted over the shield 51 (FIGS. 3 and 4, position II). At the same time or immediately after this, compressed air is blown into the shield 51 through the nozzle 5 as a result of the opening of a valve, and a turbulent air flow is generated, in an alternating sequence through the nozzles 5 and 5′, in the design with two nozzles shown in FIG. 3 (position II). At the same time, the free thread end F′ is conveyed into the shield 51 as a result of the injector effect occurring at the entrance of the shield 51. In contrast to this procedure, the free thread end F′, after being cut to length, can be returned by the pair of rollers 2, 20 in the direction of the bobbin S and the returned thread length can be received, for example, by a pneumatic thread store. Then, as a result of a reversal of the direction of rotation of the pair of rollers 2, 20, after pivoting over the shield 51, the free thread end F′ is brought again to the original predetermined length relative to the retention point and is sucked into the shield 51 by the air flow. In this procedure, during the pivoting of the pair of rollers 2, 20, only a short piece of thread projects from the pair of rollers. This procedure can be adopted advantageously to achieve better handling, even after preparation, for the introduction of the thread end into the thread draw-off tube.

The turbulent air flow guided through the shield 51 causes the free thread end F′ to execute whiplash-like oscillations and consequently ensures that individual fiber ends are exposed and spread away from the thread surface, as indicated in FIGS. 3 and 4 (position III). As a result of the rough inner wall 52 or of at least one edge-like projection in the shield 51, which are located in the region of the oscillating thread end F′ and against which the thread end F′ is whipped by the turbulent air flow, the exposure of fiber ends is accelerated even more and a minimum amount of time is required for the preparation of the free thread end F′. Individual fibers or fiber pieces which possibly come away from the point of separation or from the piece of thread during this preparation are removed through a suction line 53 connected to the shield (FIG. 2).

After a time which is predetermined as a function of the amount of twist and the thickness of the thread, the supply of compressed air to the shield 51 is discontinued, and the pair of rollers 2, 20, with the prepared thread end F′ retained by it, is pivoted in front of the orifice of the thread outlet tube 11 of the open-end spinning apparatus (FIGS. 3 and 4, position IV). As a result of the vacuum prevailing in the spinning apparatus, the thread end F′ is drawn into the thread outlet tube 11 and, after being released by the pair of rollers 2, 20, finally arrives at the fiber-collecting surface 6 of the spinning apparatus, where it is placed onto the fiber ring provided.

In a second exemplary embodiment, for the preparation of a free thread end the pair of rollers 2, 20 has assigned to it a suction-air nozzle 7 with a tubular shield 51 which is arranged inside the latter and which is located in the pivoting range of the pair of rollers 2, 20 (FIG. 5).

Because a suction-air nozzle is used, the thread can be prepared more economically, since suction air is required for the various servicing jobs and is consequently also available for preparing the thread end. The suction-air nozzle 7 can be in one piece with the shield 51 or else can be connected releasably to it. The shield 51 is arranged by means of a mounting 50 essentially in the direction of emergence of the thread F from the pair of rollers 2, 20 and is connected to the suction line 53.

The suction line 53 is preferably connected to the suction device generating the spinning vacuum, so that the suction-air flow conveyed through the shield 51 corresponds to the spinning vacuum during rotor spinning, this being conventionally 700 mm head of water.

The suction-air nozzle 7 has, as near as possible to its run-in orifice for the free thread end F', at least one secondary air orifice 71 which opens into the suction-air nozzle off-center relative to the bore axis of the latter and preferably tangentially relative to the inside diameter (FIG. 7). In the preferred design illustrated, four secondary air orifices 71 arranged offset relative to one another are distributed over the periphery of the suction-air nozzle 7, and each of them opens into the suction-air nozzle 7 off-center relative to its bore axis and tangentially relative to the inside diameter. It is important, here, that the secondary air orifices 71 should be arranged so that the turbulent air flow generated by the suction-air nozzle 7 and conveyed through the shield 51 has superimposed on it a torsional flow component which matches the spinning twist of the thread end to be prepared and which prevents the thread from untwisting. The secondary air orifices 71 are produced in a simple way by cutting out in a groove-like manner or slitting the free end of the nozzle wall surrounding the run-in orifice.

The free thread end is introduced into the suction-air nozzle 7 and the shield 51 located after it through the run-in orifice 81 which is arranged centrally in a cover 8 engaging over the wall of the suction-air nozzle 7. The cover 8 is fastened releasably to the suction-air nozzle, and can therefore be removed, so that the suction-air nozzle and the shield 51 are accessible for servicing work. Moreover, the apparatus is simpler to produce because the run-in orifice 81 is provided in a cover. When a cover engaging over the wall of the suction-air nozzle is used, each of the secondary air orifices 71 communicates with the atmosphere via a bypass 72. A funnel-shaped widened portion of the run-in orifice, as shown in FIG. 6, makes it easier to suck the thread end to be prepared into the suction-air nozzle 7 and the shield 51. To generate an appropriately high turbulent air flow, the flow cross-section of the run-in orifice 81 for the free thread end is made smaller than that of the secondary air orifices. When the spinning vacuum of 700 mm head of water is used for the thread preparation, a run-in orifice 81 having a diameter of 2 to 5 mm is provided, depending on the yarn thickness. These dimensions have proved particularly beneficial under the given conditions.

For the piecing of a rotor spinning apparatus, a free thread end is preferably prepared in a length which corresponds approximately to the diameter of the spinning rotor. Here again, the preparation is accelerated because the inner wall 52 of the shield 51 is provided with at least one projection extending in the longitudinal direction of the shield and having a sharp edge or a rough surface (FIG. 5). In the design according to FIG. 6, the shield 51 is designed as a sleeve, the inner wall of which is provided with the sharp-edged projection 54 or the rough surface. In this design, the shield 51 is clamped by means of a union nut 91 in a mounting 9 designed as a clamping bush and intended for suction-air nozzle 7. After the union nut 91 has been loosened, the shield 51 can be displaced axially, as indicated by the double arrow, so that the sharp-edged projection or the rough surface can be brought, according to the thread length to be prepared, into the region of the thread end made to execute whiplash-like oscillations by the turbulent suction-air flow. At the same time, according to previous experience, with a suction-air flow corresponding to a spinning vacuum of 700 mm head of water, the best possible preparation of the free thread end is achieved when the distance W between projections 54 of the shield 51 is in the range of 8 to 15 mm.

In contrast to the procedure adopted in the first exemplary embodiment, the thread F extending according to FIG. 1 from the bobbin S up to the lower part of the suction tube 14 and grasped by the pair of rollers 2, 20 in the thread take-up position I is severed only after the pair of rollers 2, 20 has been pivoted over the run-in orifice 81 of the suction-air nozzle 7 and has consequently paid out the thread from the thread take-up position I to beyond the preparation device. Severing is carried out by the knife 15 in interaction with the anvil roller 16, these being arranged at a predetermined distance from the suction-air nozzle 7 (FIG. 5). The severed thread end is sucked through the suction tube 14, while at the same time the free thread end F', retained by the pair of rollers 2, 20 positioned in close proximity in front of the funnel-shaped widened portion, is sucked through the run-in orifice 81 into the suction-air nozzle 7 and the shield 51, into which suction air is introduced as a result of the opening of a valve shortly before the thread is cut to length. The turbulent suction-air flow thereby generated causes the free thread end F' to execute whiplash-like oscillations, with the result that fiber ends are spread away from the thread surface and the thread acquires a rougher surface.

At the same time, as already mentioned above, the spinning twist is maintained in the thread end, so that the thread end preserves its strength. Here again, the thread end F' is prepared very quickly, because the thread end is whipped against the rough inner wall 52 of the shield 51.

When the preparation of the thread end has terminated after a predetermined time, the supply of suction air is discontinued. To make it easier to introduce the prepared free thread end into the spinning apparatus, the latter can subsequently be brought to the length suitable for introduction, for example, by driving the bobbin S in the winding-on direction and winding a specific thread length back onto the bobbin S. The pair of rollers 2, 20 with the prepared thread end is now pivoted into the thread delivery position IV in front of the orifice of the thread draw-off tube 11 (FIG. 1). There, as a result of the vacuum prevailing in the spinning apparatus, the thread end is drawn into the thread draw-off tube 11. After a specific thread length wound back onto the bobbin S has been returned into the thread draw-off tube 11, the free thread end is released by the pair of rollers 2, 20 and arrives at the fiber-collecting surface of the spinning apparatus, where it is placed onto the fiber ring provided.

The apparatus described can be modified and developed in various ways. Thus, the shield 51 can be provided with a longitudinal slit for the introduction of the thread end F'. Depending on the conditions of space, it is also possible to arrange the shield 51 transversely relative to the direction of emergence of the thread from the pair of rollers 2, 20 or from another thread-holding device, for example a thread clamp. Furthermore, it is also possible to provide, instead of a fixed shield 51, a movable shield which is advanced to the free thread end F' and which also serves at the same time for guiding the free thread end F' into the thread outlet tube 11. In this case, the shield receives, in the direction of movement of the thread towards the spinning apparatus, a longitudinal slit, through which the thread running into the spinning apparatus is released during the return movement of the shield into the initial position. It is likewise possible, of course, to make such an apparatus according to the invention for the preparation of the thread end stationary at each spinning station.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A process for preparing a thread end for the repiecing of an open-end spinning apparatus having a spinning rotor, in which the thread end is cut to the length of a pieceable end, wherein, after cutting to length, the retained free thread end is exposed to a turbulent air flow which causes the thread end to execute whiplash-like oscillations effecting a roughening of the surface of the free thread end while the spinning twist is maintained in the thread end, and the thread end prepared in this way is subsequently transferred to the fiber-collection surface of the open-end spinning apparatus.

2. A process as claimed in claim 1, wherein the thread to be prepared for piecing is paid out from the thread take-up position to a joining position corresponding to a point beyond the preparation device and is subsequently cut to length, whereupon the free thread end thus obtained is sucked into the preparation device.

3. A process as claimed in claim 1, wherein cutting to length is carried out by a cutting device.

4. A process as claimed in claim 1, wherein the free thread end is whipped against an edge-like projection.

5. A process as claimed in claim 1, wherein the free thread end is whipped against a rough surface.

6. A process as claimed in claim 1, wherein the free end of the thread is prepared in a length which is greater than the staple length of the fibers making up the thread.

7. A process as claimed in claim 1, wherein, during preparation, the thread is retained at a distance from its free end which is 1.5 times the staple length.

8. A process as claimed in claim 1, wherein the free end of the thread is prepared in a length which corresponds approximately to the diameter of the spinning rotor.

9. A process as claimed in claim 1, wherein the free thread end, after being cut to length, is brought to the distance from the retention point which is necessary for preparation.

10. A process as claimed in claim 2, wherein, after preparation, the free thread end is brought to a length suitable for introduction into the spinning apparatus and, after introduction, is returned to the joining position, from which it is released for the joining operation.

11. An apparatus for preparing an end of a twisted thread prior to piecing up of the thread in a rotor of an open end spinning apparatus comprising:

a thread-holding device holding the thread at a distance from its end and providing a free end, at least one air nozzle means associated with said thread-holding device supplying a stream of air into said thread holding device in the same direction as the twist in said thread, said air nozzle means generating turbulent air flow causing said free end to execute whiplash-like oscillations effecting a roughening of the surface of the free thread end while the spinning twist is maintained in the thread end.

12. An apparatus as claimed in claim 11, wherein one edge-like projection is provided in the region of the oscillating thread end.

13. An apparatus as claimed in claim 11, wherein a rough surface is provided in the region of the oscillating thread end.

14. An apparatus as claimed in claim 11 further comprising a tubular shield through which said turbulent air flow is guided surrounding the free end of said thread.

15. An apparatus as claimed in claim 14, wherein said air nozzle is directed against the inner wall of said tubular shield.

16. An apparatus as claimed in claim 14, wherein said air nozzle is directed into said shield at an acute angle relative to a center axis of said tubular shield.

17. An apparatus as claimed in claim 14 wherein said air nozzle includes a plurality of air nozzles located opposite one another, and means for supplying compressed air in an alternating sequence to said air nozzles.

18. An apparatus as claimed in claim 14 further comprising a suction line connected to said shield.

19. An apparatus as claimed in claim 11, wherein said nozzle is a suction nozzle which includes secondary air orifices, said secondary air orifices being located behind a run in orifice through which the free thread end passes passing in the direction of flow of the air.

20. An apparatus as claimed in claim 19, wherein the secondary air orifices open into the suction-air nozzle off-center relative to the bore axis of the latter.

21. An apparatus as claimed in claim 20, wherein the secondary air orifices open into the suction-air nozzle tangentially relative to the inside diameter of the latter.

22. An apparatus as claimed in claim 21, wherein each secondary air orifice directs air in the same rotational direction.

23. An apparatus as claimed in claim 19, wherein the flow cross-section of the run-in orifice is smaller than that of the secondary air orifices.

24. An apparatus as claimed in claim 23, wherein the diameter of the run-in orifice for the free thread end is 2 to 5 mm depending on the yarn thickness.

25. An apparatus as claimed in claim 19, wherein the run-in orifice is located in a cover engaging over the wall of the suction-air nozzle.

26. An apparatus as claimed in claim 19, wherein the run-in orifice has a funnel-shaped widened portion, above which the thread-holding device can be positioned in close proximity.

27. An apparatus for preparing an end of thread prior to piecing up of the thread in a rotor of an open end spinning apparatus comprising:

a thread-holding device holding the thread at a distance from its end and providing a free end;

at least one air nozzle associated with said thread-holding device, said air nozzle having a run-in orifice through which the thread end passes in the direction of flow of the air, and said nozzle generating a turbulent air flow causing said end to execute whiplash-like oscillations;

wherein said air nozzle is a suction-air nozzle which includes four secondary air orifices arranged offset relative to one another and distributed over the periphery of said suction-air nozzle, said secondary air orifices being located behind said run-in orifice, and each of the secondary air orifices communicates with the atmosphere via a bypass.

28. An apparatus as claimed in claim 14, further comprising a suction line, and wherein said air nozzle is a suction-air nozzle connected to said suction line via said shield.

29. An apparatus as claimed in claim 28, wherein said suction line is connected to the suction device generating the spinning vacuum.

30. An apparatus as claimed in claim 28, wherein the suction-air nozzle is made in one piece with said shield.

31. An apparatus as claimed in claim 14, wherein said shield is slotted in the longitudinal direction.

32. An apparatus as claimed in claim 31, wherein said shield is slotted towards the spinning apparatus in the direction of movement of the thread.

33. An apparatus as claimed in claim 14, wherein said shield is a square tube.

34. An apparatus as claimed in claim 14, wherein the shield is arranged essentially in the direction of emergence of the thread from the thread-holding device.

35. An apparatus as claimed in claim 14, wherein said shield is arranged transversly relative to the direction of emergence of the thread from said thread-holding device.

36. An apparatus as claimed in claim 14, wherein said thread-holding device is movable between a thread take-up position and a position delivering the thread end to the fiber-collecting surface of the open-end spinning apparatus.

37. An apparatus as claimed in claim 36, wherein the shield is arranged stationary in a pivoting range of said thread-holding device.

38. An apparatus as claimed in claim 14, further comprising:

means for advancing said shield to the free thread end.

39. An apparatus as claimed in claim 38, wherein the shield serves at the same time for guiding the free thread end into the thread draw-off tube of the spinning apparatus.

40. An apparatus as claimed in claim 12, wherein at least two edge-like projections are provided in the shield in the region of the oscillating thread end and the distance between said projections of the shield is in a range of 8 to 15 mm.

41. An apparatus as claimed in claim 14, wherein the shield is designed as a sleeve which is arranged so as to be axially displaceable in a mounting of the nozzle.

42. An apparatus for preparing an end of a twisted thread prior to piecing up of the thread in a rotor of an open end spinning apparatus comprising:

means for withdrawing thread from a takeup bobbin;

means for grasping said withdrawn twisted thread;

a thread end preparation means including:

(i) an elongated member;

(ii) means for supplying a stream of fluid into said elongated member in the same direction as the twist in said thread;

said grasping means holding the free end of said thread in a predetermined position within said thread preparation means so that the free end of said thread is engaged by said fluid stream in the same direction as the twist in said thread to prepare the end thereof by roughing said thread end while maintaning the twist in said thread; and means for transferring said thread into said spinning apparatus for piecing up the prepared end of said thread with fibers being supplied to the rotor of said spinning apparatus.

43. An apparatus for preparing an end of a twisted thread prior to piecing up of the thread in a rotor of an open end spinning apparatus comprising:

means for accelerating the end of said thread with a stream of air fed in the direction of twist of said twisted thread roughening the end portion of said thread while mountaining the twist in the end thereof;

means for transferring said end of said thread into a rotor of an open end spinning apparatus for being joined with fibers being fed thereto; and means for withdrawing said joined thread from said open end spinning aparatus.

44. A method of preparing the end of twisted yarn for piecing up with fibers being supplied to a rotor of a spinning apparatus comprising the following steps:

feeding said end of yarn into a fluid treatment device, supplying a stream of air into said fluid treatment device in the direction of twist of said twisted yarn for roughening the end portion of the yarn while maintaining the twist in said end portion; and transferring said twisted roughened end of said yarn to said spinning rotor for being joined with fibers being supplied to the rotor.

45. A method of preparing the end of twisted yarn for piecing up with fibers being supplied to a rotor of a spinning apparatus comprising the following steps:

withdrawing the end of the yarn from a takeup package;

grasping an end portion of said yarn and allowing a predetermined length of yarn to extend into a yarn treatment device;

accelerating the end of the yarn in said yarn treatment device with a stream of air coming into said treatment device in the same direction as the twist in said yarn for roughening the end portion of said yarn while maintaining the twist therein;

transferring said end portin of said yarn from said treatment device to said spinning rotor for being pieced up with fibers being supplied to said spinning rotor; and withdrawing said pieced up yarn from said spinning rotor.

* * * * *